US008020752B2

(12) United States Patent
Hjorth

(10) Patent No.: US 8,020,752 B2
(45) Date of Patent: Sep. 20, 2011

(54) SECURITY RECEPTACLE

(75) Inventor: Jens Hjorth, Seattle, WA (US)

(73) Assignee: Hjorth Consultant, Inc., Seattle, WA (US)

( * ) Notice: Subject to any disclaimer, the term of this patent is extended or adjusted under 35 U.S.C. 154(b) by 70 days.

(21) Appl. No.: 12/406,858

(22) Filed: Mar. 18, 2009

(65) Prior Publication Data

US 2009/0314828 A1 Dec. 24, 2009

Related U.S. Application Data

(60) Provisional application No. 61/038,349, filed on Mar. 20, 2008.

(51) Int. Cl.
*B65G 11/04* (2006.01)

(52) U.S. Cl. ..... 232/47; 232/44

(58) Field of Classification Search ..... 232/45, 232/47–52, 17, 44, 43.1; 109/66–68; 220/810
See application file for complete search history.

(56) References Cited

U.S. PATENT DOCUMENTS

| | | | | | |
|---|---|---|---|---|---|
| 27,466 | A | * | 3/1860 | North | 232/47 |
| 132,865 | A | * | 11/1872 | Sinclaire | 232/48 |
| 400,299 | A | * | 3/1889 | Chappell | 232/48 |
| 445,497 | A | * | 1/1891 | Catudal | 232/47 |
| 455,373 | A | * | 7/1891 | Wesson | 232/36 |
| 492,564 | A | * | 2/1893 | Smith | 232/24 |
| 507,956 | A | * | 10/1893 | Wolf | 232/47 |
| 674,619 | A | * | 5/1901 | Smith | 232/48 |
| 741,865 | A | * | 10/1903 | Williams | 232/48 |
| 807,764 | A | * | 12/1905 | Mowers et al. | 232/48 |
| 830,231 | A | | 9/1906 | Homme | |
| 890,766 | A | * | 6/1908 | Hann | 232/51 |
| 1,150,039 | A | * | 8/1915 | Klingaman | 232/48 |
| 1,237,199 | A | * | 8/1917 | Graves | 232/49 |
| 2,405,730 | A | | 8/1946 | Bankson | |
| 3,874,583 | A | | 4/1975 | Moll | |
| 3,976,345 | A | | 8/1976 | Walters | |
| 5,435,484 | A | | 7/1995 | Carlson | |
| 6,138,910 | A | | 10/2000 | Madruga | |
| 6,347,737 | B1 | | 2/2002 | Madruga | |
| 6,655,577 | B2 | | 12/2003 | Mihaylov | |
| 6,719,195 | B2 | | 4/2004 | Farentinos | |
| 7,252,220 | B1 | | 8/2007 | Shreve | |

* cited by examiner

*Primary Examiner* — William L. Miller
(74) *Attorney, Agent, or Firm* — Christensen O'Connor Johnson Kindness PLLC

(57) ABSTRACT

A security receptacle generally includes an outer housing defining an inner chamber and having an inlet thereto, and a movably connected top door for selectably closing the inlet, wherein the top door is configured for movement between an open position and a closed position. The security receptacle further includes an inner shield for dividing the inner chamber into a receipt chamber and a holding chamber to prevent user access to the holding chamber from the inlet, wherein the inner shield is driven by the movement of the top door through a cam assembly.

10 Claims, 5 Drawing Sheets

SECURITY RECEPTACLE

CROSS-REFERENCE TO RELATED APPLICATION

This application claims the benefit of U.S. Provisional Application No. 61/038,349, filed on Mar. 20, 2008, the disclosure of which is expressly incorporated herein by reference.

BACKGROUND

Embodiments of the present disclosure relate to mail boxes or receptacles that secure stored contents when new contents are being deposited. Known prior art includes a U.S. Postal Service (USPS) mail deposit box. These mail deposit boxes are generally designed to include a one-piece, rotating receipt chamber that rotates around a pivot. The handle for the deposit box is on the outside of a first wall of the receipt chamber. The act of pulling the handle causes the chamber to rotate forward from a closed position to an open position to receive mail. When in the open position, a second, opposing wall of the chamber blocks access to the holding chamber of the deposit box. The act of closing the first wall (or door) of the receipt chamber causes the chamber to rotate back to its closed position, resulting in the mail being dropped from the receipt chamber into the holding chamber below.

Such rotating receipt chambers are not 100% reliable in maintaining mail security for users. In that regard, mail sometimes fails to drop from the rotating receipt chamber into the holding chamber below when the receipt chamber is rotated to its closed position. When the mail fails to drop, the next user of the mail deposit box will have access to the mail when the receipt chamber is rotated to its open position. Hence, there exists a need for an improved design for security receptacles or mail boxes over current USPS drop boxes.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with one embodiment of the present disclosure, a security receptacle is provided. The security receptacle generally includes an outer housing defining an inner chamber and having an inlet thereto, and a movably connected top door for selectably closing the inlet, wherein the top door is configured for movement between an open position and a closed position. The security receptacle further includes an inner shield for dividing the inner chamber into a receipt chamber and a holding chamber to prevent user access to the holding chamber from the inlet, wherein the inner shield is driven by the movement of the top door through a cam assembly.

In accordance with another embodiment of the present disclosure, a security receptacle is provided. The security receptacle generally includes an outer housing defining an inner chamber and having an inlet thereto, and a movably connected top door for selectably closing the inlet, wherein the top door is configured for movement between an open position and a closed position. The security receptacle further includes an inner shield for dividing the inner chamber into a receipt chamber and a holding chamber to prevent user access to the holding chamber from the inlet, wherein the inner shield is driven by the movement of the top door through a cam assembly, wherein the inner shield is driven into its shielding position by initial movement of the top door, and wherein the cam assembly includes a cam track having first and second connecting track portions.

DESCRIPTION OF THE DRAWINGS

The foregoing aspects and many of the attendant advantages of this disclosure will become more readily appreciated by reference to the following detailed description, when taken in conjunction with the accompanying drawings, wherein.

DETAILED DESCRIPTION

Figure 1:
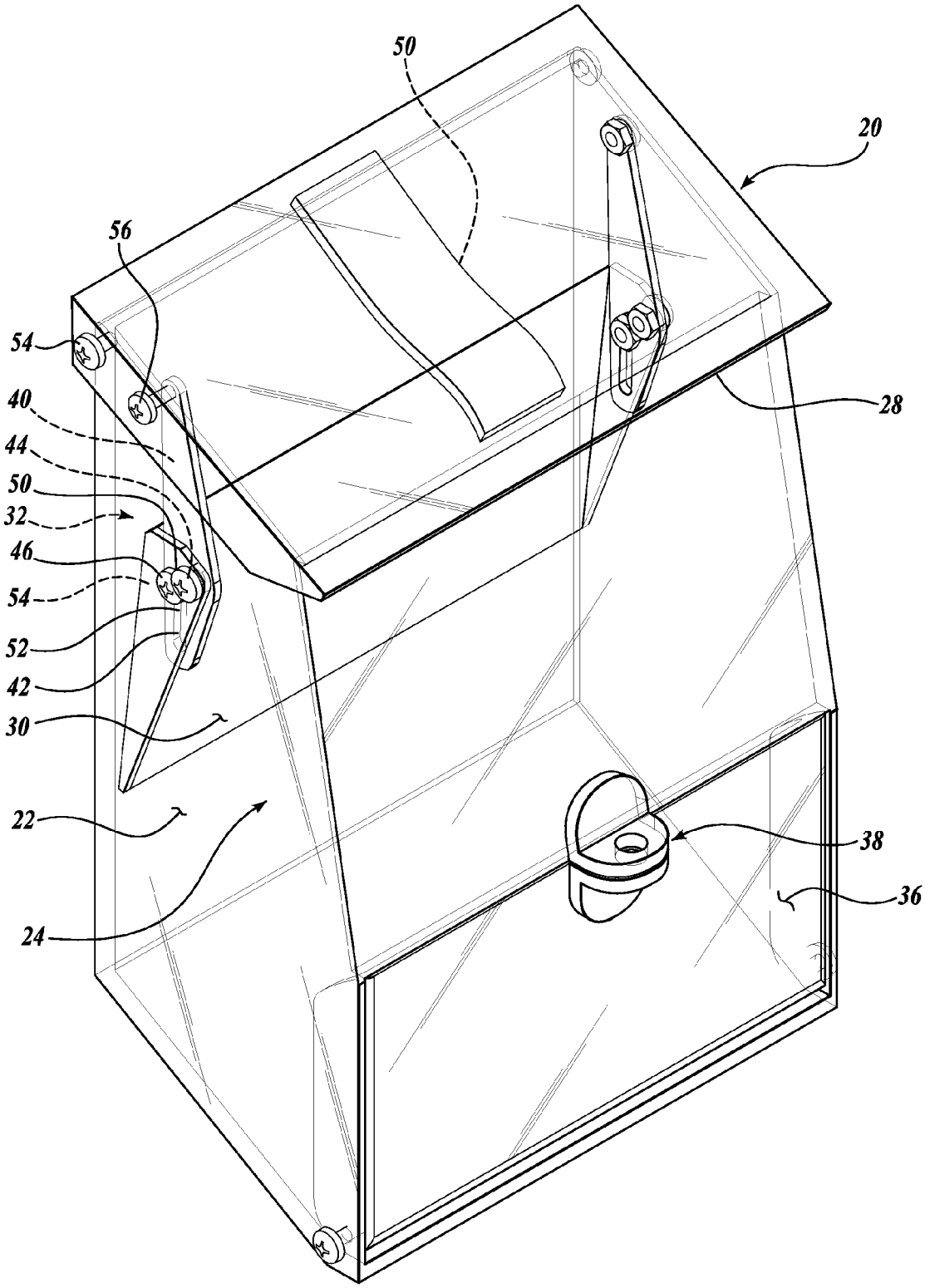
FIG. 1 is a perspective view of a security receptacle in accordance with one embodiment of the present disclosure, wherein a top door (or lid) is in a closed position and a bottom door is in a closed position.

Referring to FIGS. 1-5, a security receptacle 20, shown as a mail box, in accordance with one embodiment of the present disclosure is shown. The receptacle 20 has an outer housing 22 defining an inner chamber 24 and having an inlet 26 thereto (see FIG. 4), a movably connected top door (or lid) 28 at the inlet 26, and an inner shield 30 driven by the movement of the lid 28 through a cam assembly 32. The receptacle 20 further includes an outlet 34 (see FIG. 5) including a bottom door 36 pivotably mounted to the outer housing 22 and having a lockable mechanism 38. In contrast to this single piece rotating receipt chamber, the present device uses an inner shield that is driven by the movement of the lid through a cam assembly.

Figure 4:
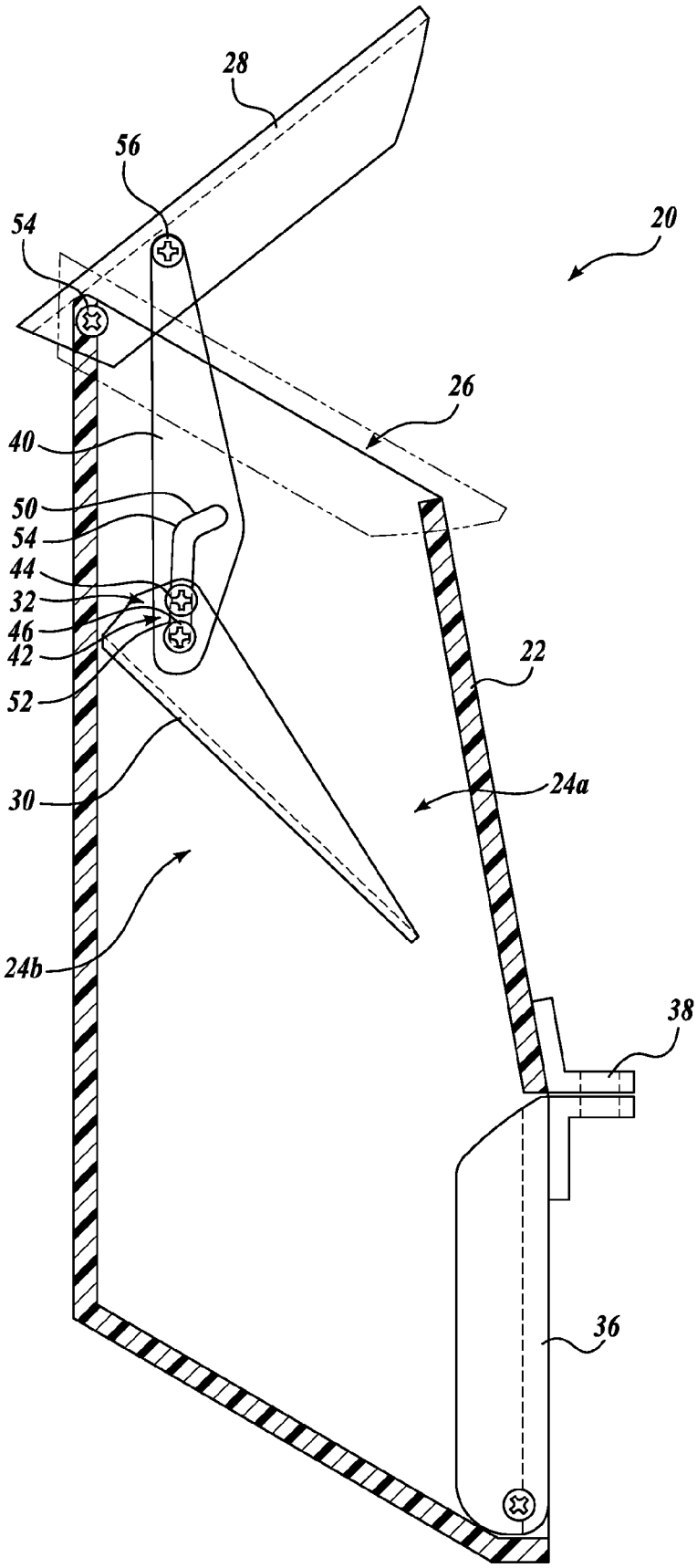
FIG. 4 is a side view of the security receptacle of FIG. 2, wherein the lid is in an open position and the bottom door is in a closed position.
Figure 5:
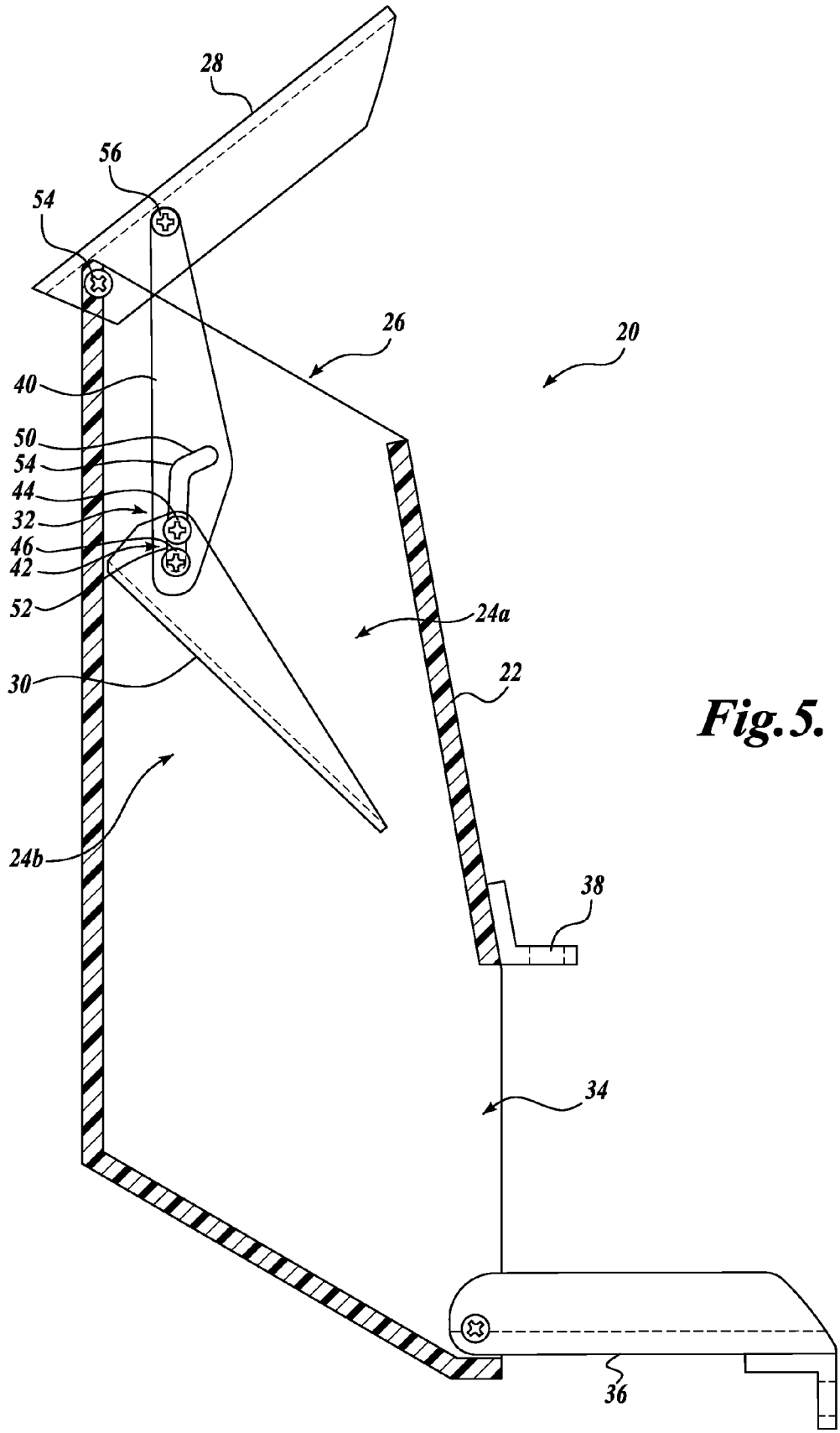
FIG. 5 is a side view of the security receptacle of FIG. 2, wherein the lid is in an open position and the bottom door is in an open position.

In use, the lid 28 is moveable between a closed position (see FIG. 2) and an open position (see FIG. 4). When the lid 28 is moved by a user to the open position (see FIG. 4), the inner shield 30 is driven from a non-shielding position into a shielding position, dividing the inner chamber 24 into a receipt chamber 24*a* and a holding chamber 24*b* to prevent access to the holding chamber 24*b* from the inlet 26. Therefore, when the lid 28 is in the open position, access into the holding chamber 24*b* is blocked by the inner shield 30 to protect the contents in the holding chamber 24*b*.

When the lid 28 is returned to the closed position (see FIG. 2), the inner shield 30 is driven from a shielding position into a non-shielding position (e.g., a substantially vertical position, as seen in the illustrated embodiment), allowing the deposited mail to fall into the holding chamber 24*b*. A user can access the contents in the holding chamber 24*b* by disarming the lockable mechanism 38 on the bottom door 36 (see FIG. 5).

Figure 2:
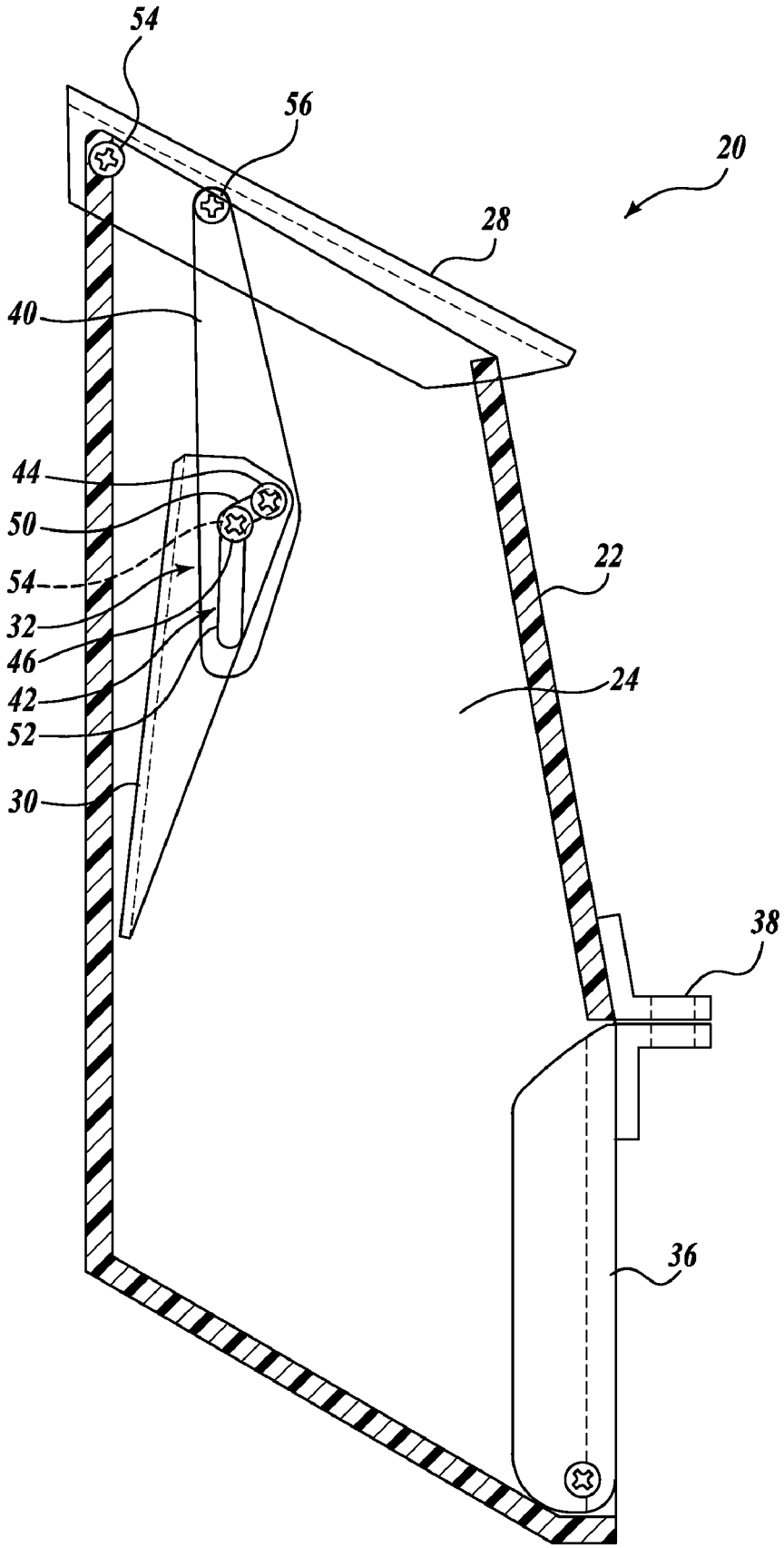
FIG. 2 is a side view of a security receptacle in accordance with one embodiment of the present disclosure, wherein the lid is in a closed position and the bottom door is in a closed position.
Figure 3:
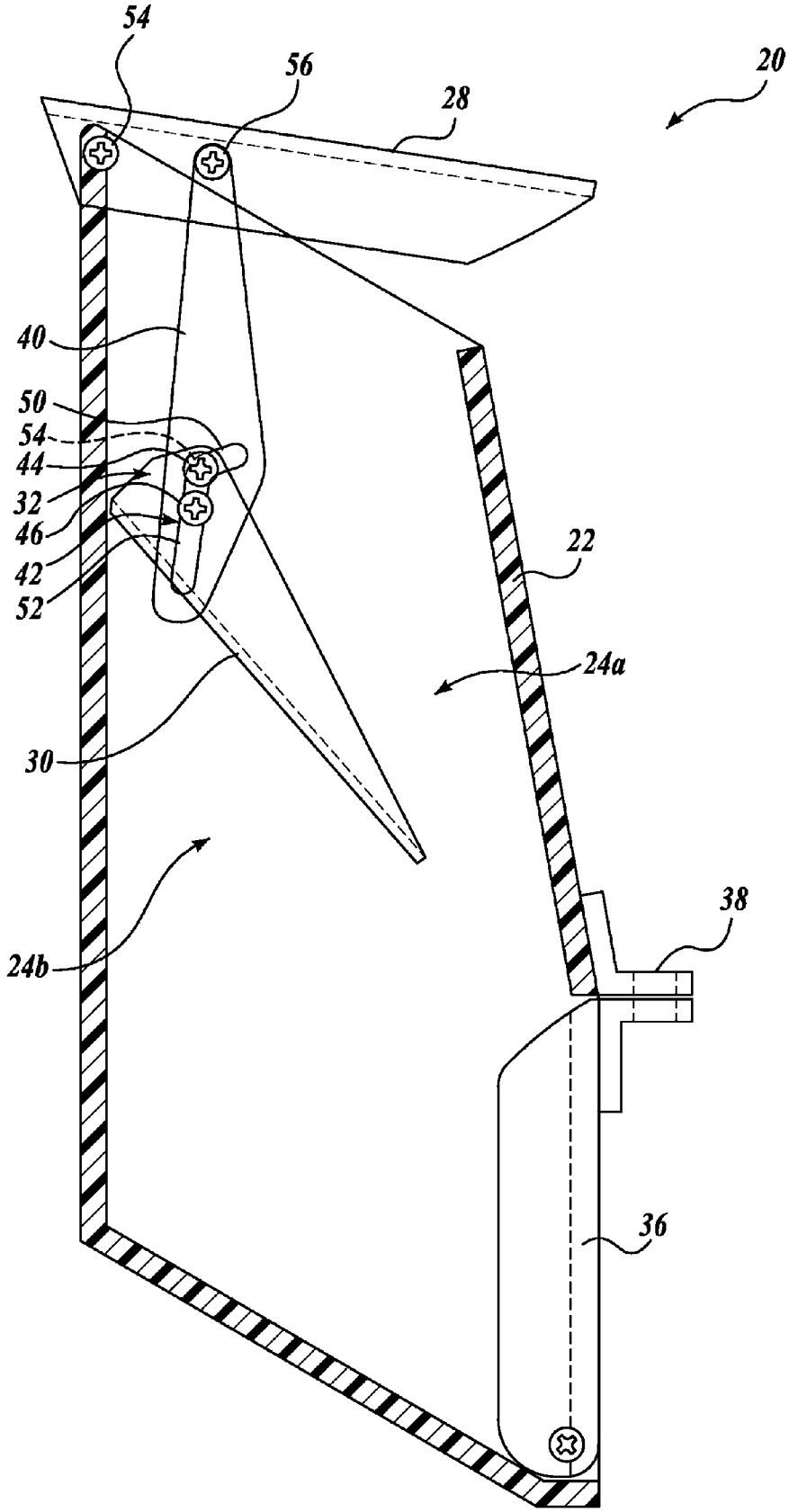
FIG. 3 is a side view of the security receptacle of FIG. 2, wherein the lid is moving from the closed position to an open position and the bottom door is in a closed position.

In the illustrated embodiment, the lid 28 is pivotable along a pivot axis, which is created by pivot means, shown as lid pivot attachment devices 54 in the illustrated embodiment of FIGS. 2-4. Therefore, the lid fasteners 54 pivotably attach the lid 28 to the housing 22. It should be appreciated, however, that pivot means may include fasteners, screws, bolts, pins, shaft, hinges, living hinges, or other pivot means known in the art.

Although shown in the illustrated embodiment as a lid 28, it should be appreciated that the top door may also pivot with a similar movement as the bottom door 36, outwardly from the front vertical wall of the outer housing 22. If designed to pivot as a door rather than a lid, it should be appreciated that the top door 28 and the cam assembly 32 (described in greater detail below) will be configured to drive the inner shield 30 between shielding and non-shielding positions.

Referring to FIGS. 1-4, the cam assembly 32 that drives the inner shield 30 by movement of the lid 28 will now be described in greater detail. As seen in FIG. 1, the cam assembly 32 includes two cam arms 40 that are driven by the movement of the lid 28. In that regard, the cam arms 40 are pivotably attached to respective ends of the lid 28 by cam arm attachment devices 56, shown in the illustrated embodiment as fasteners. Referring to FIG. 2, when the lid 30 is in the closed position, the cam arms 40 are in their lowered position. While the cam assembly 32 of the illustrated embodiment of FIG. 1 includes two cam arms, it should be appreciated that a cam assembly 32 driven by a single cam arm is also within the scope of the disclosure.

Now referring to FIGS. 3 and 4, as the lid 28 is lifted, the cam arms 40 are raised from their lowered position by virtue of their attachment to the lid by cam arm fasteners 56 at a point along the lid 28 that is spaced a predetermined distance from the pivot axis of the lid 28. In that regard, as the lid 28 rotates around its pivot axis from a closed position to an open position, the cam arm fasteners 56 move in an arc determined by the angle of rotation of the lid 28 around the pivot axis and the position of the cam arm fasteners 56 from the pivot axis.

It should be appreciated that in the illustrated embodiment, the cam arm fasteners 56 move in an arced path around the pivot axis of the lid 28. The pivotal attachment of the cam arms 40 to the lid 28 allows the cam arms 40 of the illustrated embodiment to maintain a substantially vertical orientation as the cam arm fasteners 56 move in the arced path. However, it should be appreciated that the receptacle 20 may be configured such that the cam arms 40 are fixedly attached to the lid 28, such that the orientation of cam arms 40 is determined by the angle of rotation of the lid 28 around the pivot axis.

The cam arms 40 each include a cam track 42. In the illustrated embodiment, the cam tracks 42 are grooves extending along the cam arms 40, which are shown to extend through the cam arms 40; however, it should be appreciated that in other embodiments, the cam tracks 42 may be grooves formed between ridges on the surfaces of the cam arms 40, grooves partially extending into the surfaces of the cam arms 40, or other suitable cam tracks.

The cam tracks 42 each include first and second connecting track portions 50 and 52 in an adjacent relationship to one another and joining at a juncture 54. In the illustrated embodiment, the second track portion 52 is oriented in a substantially vertical orientation and the first track portion 50 is oriented in a substantially oblique orientation relative to the second track portion 52. At the juncture 54 of the first and second track portions 50 and 52, the cam tracks 42 may be rounded to allow for ease of transition as the cam tracks 42 move in a surrounding track relationship relative to the inner shield attachment devices 44 and housing attachment devices 46, described in greater detail below. As seen in FIGS. 2-4, the inner shield attachment devices 44 and the housing attachment devices 46 are received by the cam tracks 42 and positioned adjacent one another in the cam tracks 42.

Housing attachment devices 46, shown in the illustrated embodiment as fasteners, anchor the cam assembly 32 to the outer housing 22. In the illustrated embodiment, the housing fasteners 46 are fixedly coupled to the outer housing 22 and to the inner shield 30, such that the housing fasteners 46 extend through the cam tracks 42. The cam tracks 42 are configured to move in a surrounding track relationship relative to housing fasteners 46 such that the cam tracks 42 travel relative to the housing fasteners 46. The housing fasteners 46 therefore establish the pivot axis of the inner shield 30 as it moves between shielding and non-shielding positions.

As seen in a comparison between FIGS. 2-4, the second track portions 52 of the cam tracks 42 move translationally relative to the housing fasteners 46. Referring to FIG. 1, when the lid 28 is in its closed position, the housing fasteners 46 are positioned in the second track portions 52 proximate to the track portion junctures 54. Referring to FIG. 2, when the lid 28 is moved toward its open position, the housing fasteners 46 are positioned in the second track portions 52 intermediate the track portion junctures 54 and the distal ends of the second track portions 52. Referring to FIG. 4, when the lid 28 is in its open position, the housing fasteners 46 are positioned proximate to the distal ends of each of the second track portions 52. Therefore, as the lid 28 moves from its closed position (FIG. 2) to its open position (FIG. 3), the second track portions 52 move translationally relative to the housing fasteners 46. This movement corresponds to the movement of the lid 28 along the chord extending between the arc determined by the angle of rotation of the lid 28 around the pivot axis.

Inner shield attachment devices 44, shown in the illustrated embodiment as fasteners, work in conjunction with the cam tracks 42 to allow for movement of the inner shield 30 relative to the housing 22. In the illustrated embodiment, the inner shield fasteners 44 are fixedly connected to the inner shield 30 and extend through the cam tracks 42. While the inner shield fasteners 44 are fixedly coupled to the inner shield 30, the cam tracks 42 are configured to move in a surrounding relationship relative to the cam arm fasteners 44 such that the cam tracks 42 travel relative to the cam arm fasteners 44.

Referring to FIG. 2, the inner shield fasteners 44 are initially oriented in the distal end of the first track portions 50 of the cam tracks 42. As the opening of the lid 28 is initiated (see FIG. 3), the first track portions 50 of the cam tracks 42 are moved in the vertical direction corresponding to the vertical movement of the cam arms 40. Because the inner shield fasteners 44 are not anchored to the housing 22 and because the first track portions 50 are oriented in a substantially oblique orientation relative to the first track portion 50, the first track portions 50 guide the inner shield fasteners 44 (and the inner shield 30) to the shielding position (see FIG. 3). When in the shielding position, the inner shield fasteners 44 are generally positioned near the track juncture 54 between the first and second track portions 52 and 54. As the lid 28 continues to open (see FIG. 4), the second track portions 52 of the cam tracks 42 move translationally relative to the inner shield fasteners 44, similar to the movement relative to the housing fasteners 46 described above. Referring to FIG. 4, when the lid 28 is in its open position, the inner shield fasteners 44 are positioned proximate to the distal end of the second track portions 52.

Therefore, the inner shield fasteners 44 are positioned a predetermined distance from the pivot axis (or housing fasteners 46) of the inner shield 30 to allow for rotational movement of the inner shield 30 relative to the housing 22. Accordingly, the cam tracks 42 are designed and configured to drive the inner shield 30 into its shielding and non-shielding positions.

It should be appreciated that the cam assembly 32 combines rotational and translational movement to drive the inner shield 30 into its shielding position independent of the degree of "openness" of the lid 28. For example, upon initial opening of the lid 28, the inner shield 30 is driven by rotational movement into its shielding position (see FIG. 3). As the lid 28 continues to open, the inner shield 30 remains in the same shielding position (see FIG. 4). It should be appreciated that the cam tracks 42 may be configured to require more or less "openness" of the lid 28 to drive the inner shield 30 into its shielding position. In that regard, the first cam track portions 50 may be configured to be, respectively, longer or shorter in length.

In addition, it should be appreciated that the cam arms 40 and cam tracks 42 may be sized to any length corresponding to the desired size of the receipt chamber 24*a* and the holding chamber 24*b*. It should be appreciated that the cam tracks 42 can be designed having first and second track portions in a different angular relationship relative to one another.

As best seen in FIG. 1, the receptacle 20 may further include an outgoing mail clip 50 coupled to the inner surface of the lid 28.

While illustrative embodiments have been illustrated and described, it will be appreciated that various changes can be made therein without departing from the spirit and scope of the invention.

The invention claimed is:

1. A security receptacle, comprising:

(a) an outer housing defining an inner chamber and having an inlet thereto;

(b) a movably connected top door for selectably closing the inlet, wherein the top door is configured for movement between an open position and a closed position; and (c) an inner shield for dividing the inner chamber into a receipt chamber and a holding chamber to prevent user access to the holding chamber from the inlet, wherein the inner shield is driven by the movement of the top door through a cam assembly, the cam assembly including a cam track having first and second connecting track portions, wherein the second track portion is configured in an oblique relationship to the first track portions, and wherein the cam assembly includes a housing attachment device and an inner shield attachment device, both the housing attachment device and the inner shield attachment device being received by the cam track, wherein the housing attachment device and the inner shield attachment device arc in the first track portion when the top door is in the open position, and wherein the housing attachment device is in the first track portion and the inner shield attachment device is in the second track portion when the top door is in the closed position.

2. The security receptacle of claim 1, wherein the inner shield is in a shielding position when the top door is in the open position, and wherein the inner shield is in a non-shielding position when the top door is in the closed position.

3. The security receptacle of claim 2, wherein the inner shield is driven into the shielding position by initial movement of the top door.

4. The security receptacle of claim 1, wherein the top door is a lid.

5. A security receptacle, comprising:

(a) an outer housing defining an inner chamber and having an inlet thereto;

(b) a movably connected top door for selectably closing the inlet, wherein the top door is configured for movement between an open position and a closed position; and (c) an inner shield for dividing the inner chamber into a receipt chamber and a holding chamber to prevent user access to the holding chamber from the inlet, wherein the inner shield is driven by the movement of the top door through a cam assembly, wherein the inner shield is driven into its shielding position by initial movement of the top door, wherein the cam assembly includes a cam track having first and second connecting track portions, wherein the cam assembly includes a housing attachment device and an inner shield attachment device, both the housing attachment device and the inner shield attachment device being received by the cam track, and wherein the housing attachment device and the inner shield attachment device are in the first track portion when the top door is in the open position, and wherein the housing attachment device is in the first track portion and the inner shield attachment device is in the second track portion when the top door is in the closed position.

6. A security receptacle, comprising:

(a) an outer housing defining an inner chamber and having an inlet thereto;

(b) a movably, connected top door for selectively closing the inlet, wherein the top door is configured for movement between an open position and a closed position; and (c) an inner shield for dividing the inner chamber into a receipt chamber and a holding chamber to prevent user access to the holding chamber from the inlet, wherein the inner shield is driven by the movement of the top door through a cam assembly, the cam assembly including a earn track; wherein the cam assembly includes a housing attachment device and an inner shield attachment device, both the housing attachment device and the inner shield attachment device being received by the cam track for movement in the cam track between the top door open and closed positions.

7. The security receptacle of claim 6, wherein the cam track has first and second connecting track portions.

8. The security receptacle of claim 7, wherein the housing attachment device is in the first track portion and the inner shield attachment device is in the second track portion when the top door is in the closed position.

9. The security receptacle of claim 7, wherein the housing attachment device and the inner shield attachment device are in the first track portion when the top door is in the open position.

10. The security receptacle of claim 7, wherein the second track portion is configured in an oblique relationship to the first track portion.

* * * * *

UNITED STATES PATENT AND TRADEMARK OFFICE

CERTIFICATE OF CORRECTION

PATENT NO. : 8,020,752 B2
APPLICATION NO. : 12/406858
DATED : September 20, 2011
INVENTOR(S) : J. Hjorth It is certified that error appears in the above-identified patent and that said Letters Patent is hereby corrected as shown below:

| COLUMN | LINE | ERROR |
|---|---|---|
| 5 (Claim 1, line 20) | 47 | "arc" should read --are-- |
| 6 (Claim 6, line 4) | 30 | "movably, connected" should read --movably connected-- |
| 6 (Claim 6, line 13) | 39 | "earn track; wherein" should read --cam track, wherein-- |

Signed and Sealed this
Twenty-eighth Day of August, 2012

David J. Kappos

David J. Kappos
*Director of the United States Patent and Trademark Office*